US010351406B2

(12) United States Patent
Leslie

(10) Patent No.: US 10,351,406 B2
(45) Date of Patent: Jul. 16, 2019

(54) HORIZONTAL/VERTICAL GRIP ANTI-ROTATION CAPPING KNIFE

(71) Applicant: John M. Leslie, Blountville, TN (US)

(72) Inventor: John M. Leslie, Blountville, TN (US)

( * ) Notice: Subject to any disclaimer, the term of this patent is extended or adjusted under 35 U.S.C. 154(b) by 461 days.

(21) Appl. No.: 14/998,678

(22) Filed: Jan. 30, 2016

(65) Prior Publication Data

US 2017/0217747 A1 Aug. 3, 2017

(51) Int. Cl.

| | |
|---|---|
| ***B67B 3/20*** | (2006.01) |
| ***B65B 7/28*** | (2006.01) |
| *B65B 43/54* | (2006.01) |
| *B67C 3/24* | (2006.01) |

(52) U.S. Cl.

CPC ..... *B67B 3/206* (2013.01); *B65B 7/2835* (2013.01); *B65B 43/54* (2013.01); *B67C 3/242* (2013.01)

(58) Field of Classification Search

CPC ..... B67B 3/206; B65B 7/2835; B65B 43/54; B65B 61/28; B67C 3/242; B65G 2201/0247

USPC ..... 53/300, 301

See application file for complete search history.

(56) References Cited

U.S. PATENT DOCUMENTS

| | | | | |
|---|---|---|---|---|
| 1,726,479 | A * | 8/1929 | Engle | B67C 3/04 12/37 |
| 4,114,347 | A * | 9/1978 | Morris | B67B 3/12 53/300 |
| 4,939,890 | A * | 7/1990 | Peronek | B67B 3/2033 53/289 |
| 6,334,289 | B1 * | 1/2002 | Buchel | B65G 29/00 53/201 |
| 2004/0006951 | A1 * | 1/2004 | Riggs, Jr. | B65B 7/2835 53/490 |
| 2004/0206047 | A1 * | 10/2004 | Bradley | B65B 7/2835 53/300 |
| 2005/0126119 | A1 * | 6/2005 | Bernhard | B67B 3/2033 53/167 |
| 2010/0018168 | A1 * | 1/2010 | Bruijns | B67B 3/206 53/317 |
| 2011/0131924 | A1 * | 6/2011 | Martin | B67B 3/206 53/317 |
| 2012/0017546 | A1 * | 1/2012 | Peronek | B67B 3/206 53/490 |
| 2015/0315002 | A1 * | 11/2015 | Landler | B67B 3/2026 53/490 |

* cited by examiner

*Primary Examiner* — Alexander M Valvis
*Assistant Examiner* — Lucas E. A. Palmer

(57) ABSTRACT

Disclosed is a unique knife plate structure for preventing rotation of a plastic container during the capping operation, wherein the container neck is provided with a finish ring or lip, wherein the knife plate is formed to provide laterally and vertically directed sharp edged or pointed container neck contact spikes each of which spikes penetrates (slightly) a portion of the plastic neck surface at the junction of the underside of the finish ring with the neck to hold the container in a fixed non-rotational position while the cap or lid is being rotationally applied.

2 Claims, 2 Drawing Sheets

HORIZONTAL/VERTICAL GRIP ANTI-ROTATION CAPPING KNIFE

FIELD

The present invention embodies a unique gripping device for holding a container stationary while a cap or lid is rotationally applied to the container to a predetermined specified torsion value.

PRIOR ART

In the container filling industry, a container is filled with a pre-determined amount of product and then a cap is rotationally applied while the container is being held by a pair of "anti-rotation knife plates" or "capper knives", hereinafter "knife" which engages lower portions of the container neck at a predesigned location thereon. The container, being held by the knife then goes through a "capper head" which places a cap or lid on the container neck top using a capper head device which holds the cap or lid and rotates it onto the neck top to a pre-determined torsion value.

A chronic problem with the existing knife design currently being used in the industry is that the container neck contact surface of the knife cannot firmly hold the container neck from rotating. The result is that an unacceptable cap torsion value is obtained, i.e., the torsion value is either too low or too random to meet quality capping specifications. Such devices are disclosed, for example in U.S. Pat. Nos. 7,454,878 B2, and 8,646,634 B2, in the U.S. 2004/0006951A1, and in Europäischen Patentschrift DE69808118T2, the disclosures of all of which publications are hereby incorporated herein by reference in their entireties. The DE69808118T2 shows how, e.g., the present anti-rotation knife plate can be mounted on a capper head.

SUMMARY OF THE INVENTION

In the present invention as shown in the drawings hereof, the knife plate has a plurality of formed sections or areas, each of which provides a container neck contact spike having a sharp edged—can also be a sharp point—substantially vertical neck engaging component and also having a sharp edged (can also be a sharp point) substantially lateral neck engaging component, each of which components penetrates a portion of the neck surface at the junction of a finish ring with the neck to hold the container in a fixed non-rotational position while the cap or lid is being rotationally applied.

This knife structure imparts a markedly greater resistance to container rotation than any currently available capping device. It is noted that the above combination of vertically and laterally oriented gripping components is unique to the industry and each combination of the plurality of combinations on each plate is embodied most preferably in a single spike which is formed to provide the two aforesaid spike components.

The dual contact point anti-rotation plates will be manufactured so that the two contact points lie in a common gripping plane 30 which intersects the container of any neck and a finish ring geometry. The container can be any geometry around the neck and finish ring and the anti-rotation plate will intersect at the geometry specified by the container.

BRIEF DESCRIPTION OF THE DRAWINGS

The present anti-rotation knife invention is described further in detail in the accompanying drawings wherein.

DETAILED DESCRIPTION OF THE DRAWINGS

Figure 1:
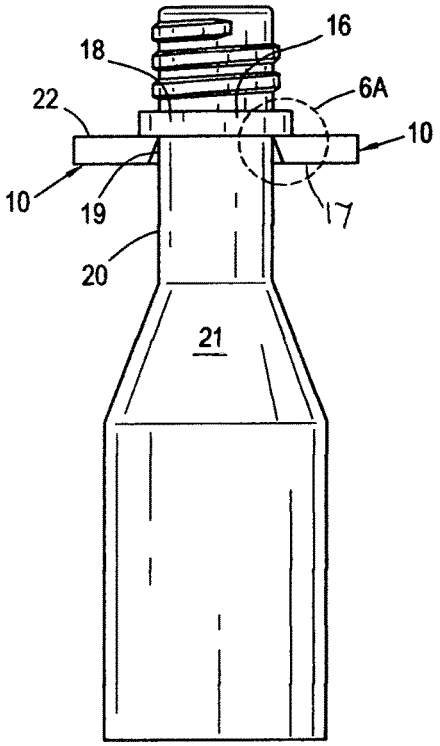
FIG. 1 is a side view of a plastic bottle showing the operating position of the present anti-rotation knife plate around the bottle neck.
Figure 2:
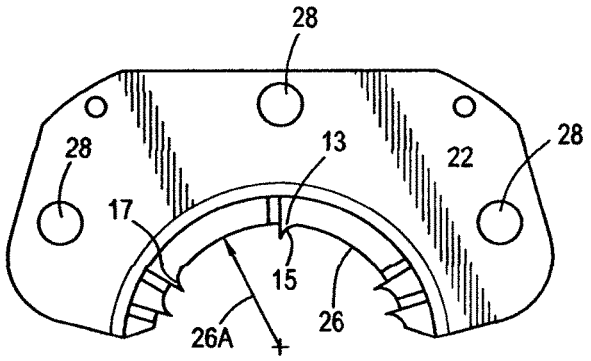
FIG. 2 is a top view of the knife plate.
Figure 3:
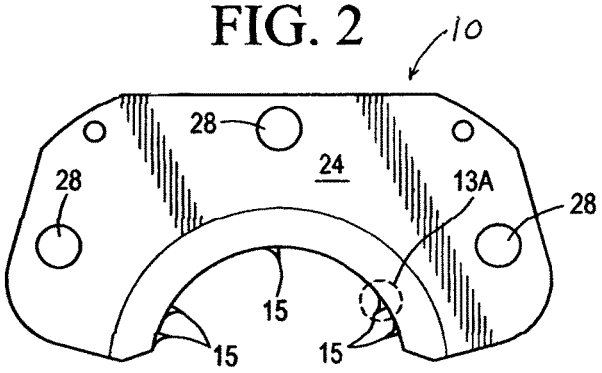
FIG. 3 is a bottom view of the knife plate.
Figure 4:
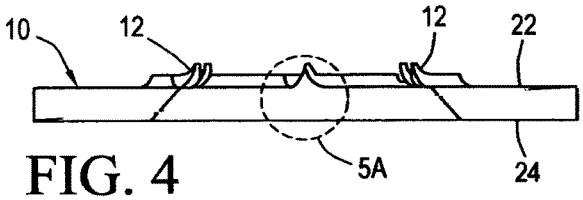
FIG. 4 is a front edge view of the knife plate.
Figure 5:
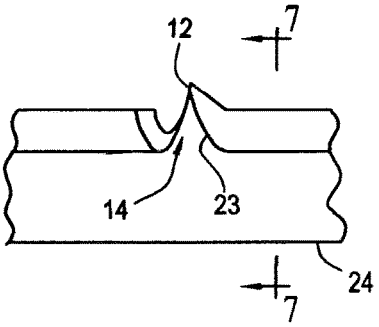
FIG. 5 is an enlarged view of the dotted line area "5A" of the knife plate in FIGS. 3 and 4.
Figure 6:
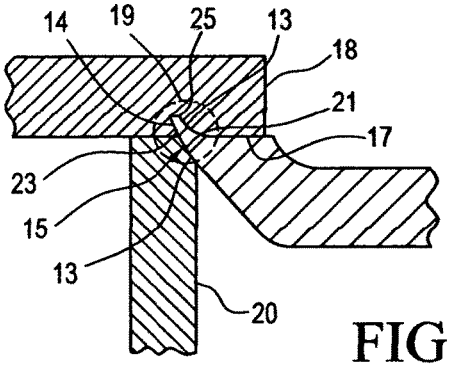
FIG. 6 is a markedly enlarged view of the dotted line portion "6A" of the operating position of the knife plate in FIG. 1 and showing a gripping spike imbedded in both the bottle neck wall and the underside of the bottle neck lip.
Figure 7:
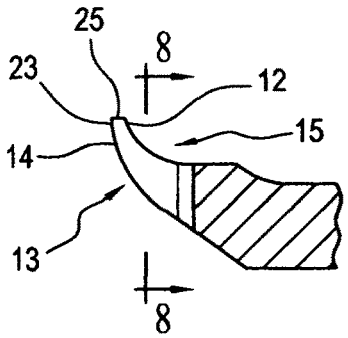
FIG. 7 is an enlarged side view of a spike taken along line 7-7 in FIG. 5.
Figure 8:
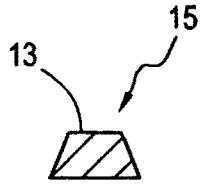
FIG. 8 is a cross-sectional view of the spike taken alone line 8-8 in FIG. 7.

With reference to the drawings and claims herein, the present capper knife, i.e., each knife plate 10 thereof, has spaced spike areas "5A" shown in dotted line in FIGS. 3 and 4, each area providing a spike 15 having dual directional contact components, i.e., generally vertical component 12 and generally lateral component 14. Component 12 engages the container neck 16 generally under the lip or "finish ring" 18 at its approximate juncture 19 (dotted line area in FIG. 6) with the neck side wall 20 of the container, which juncture is the strongest part of the container due to the plastic material thereof typically being much thicker than anywhere else on the entire container. The other (lateral) spike component 14 engages the side wall 20 surface of the container neck. The leading edge 23 of spike component 14 preferably is razor sharp as is the leading edge 25 of spike component 12.

Figure 10:
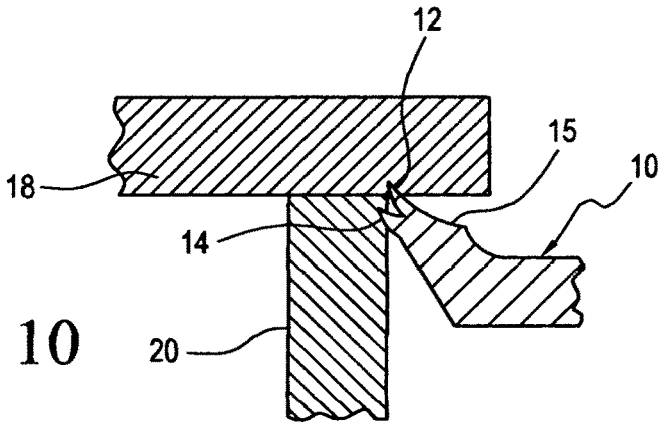
FIG. 10 is a view as in FIG. 7 showing the two leading edges of the spike contacting separate (non junction) portions of the neck and finish ring.
Figure 9:
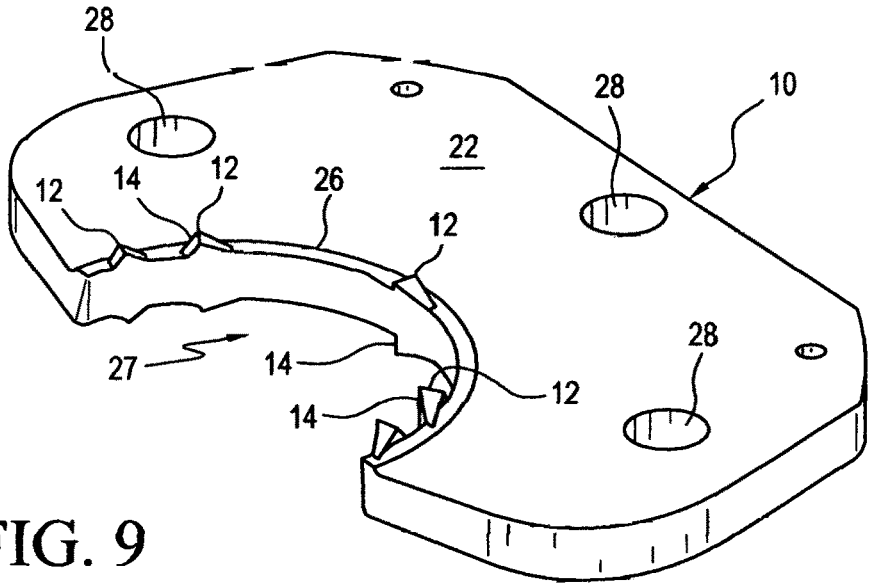
FIG. 9 is a computer generated isometric view of an embodiment of the present capper knife.

Referring to the alternative spike configuration of FIG. 10 of markedly enlarged drawing dimensions, the leading edges 23 and 25 are designed to contact separate areas of the neck 16 and lip 18. In the operation of this embodiment the lateral component 14 can be brought first into contact laterally with the neck, and then the downward capping forces can bring the bottom surface 17 of lip 18 into contact with vertical component 12. It is noted that the penetration of these spikes into the plastic is very slight, on the order, for example, of about 0.0005-0.003 in. for a typical operation, the depth of penetration which is required depending on the physical characteristics of the plastic and the torque value required. The two container holding components 12 and 14 provided by knife plate 10 are shown in greatly enlarged proportions in FIG. 6 as having penetrated into the junction area 19 which gives a significant increase in resisting torsional rotation of the container when the cap or lid is being applied in the rotative direction 27 (FIG. 9). The configuration of each spike 15 enables the spike to readily penetrate, albeit only slightly, the plastic container neck both laterally and vertically as the knife plates 10 are brought together in the capping operation as shown, e.g., in the aforesaid DE69808118T2.

The wedge shaped, sled-like, arcuate surface configuration 13 of the spike component 14 offers sufficient resistance to the lateral penetration of the spike into the wall surface portion 21 of the neck to divert the neck penetration of the spike toward a generally vertical direction whereby the spike component 12 will penetrate also generally vertically. This action also causes the top surface portion 13 of the spike to slidingly engage junction area 19 of the spike and neck and cam the knife also further laterally into the neck as downward forces of the capping process are generated against the neck and knife plate top 22. In an alternative construction, components 12 and 14 can be separately arranged around the arcuate rim 26 shown in FIG. 9.

The improved neck support knife provides planar plate 10 having top surface 22 and bottom surface 24 surrounded by an arcuate rim 26, which knife plate is adapted for attachment to a capping machine (not shown). The total included angle of the arc 26A of rim 26 can be varied over a wide range but typically is roughly semi-circular. Similarly, the shape and arrangement of bolt or screw mounting holes 28 in the rim can be modified as needed to match the configuration required for attachment to a particular capping machine. The top planar surface 22 of the knife plate 10 is adapted to engage and support lip (finish ring) 18 which extends laterally from the neck of the bottle with the bottle body suspended below the neck support knife.

The invention has been described in detail with particular reference to preferred embodiments thereof, but it will be understood that variations and modifications will be effected within the spirit and scope of the invention.

I claim:

1. A container capping knife structure for holding a plastic container against rotation during a capping operation, said knife structure comprising;

a knife plate having a planar mounting portion for attachment to a capper head of a container capping machine, said knife plate further having an arcuate rim surface which is shaped to partially surround a container neck, said neck is formed with a finish ring which forms a junction area of said neck and said ring, said arcuate rim surface being formed with an array of substantially horizontal neck engaging spikes which extend substantially laterally outward from said arcuate rim surface, said horizontal neck engaging spikes having substantially laterally extending penetrating knife edge portions, said arcuate rim surface further being formed with an array of ring engaging spikes which extend substantially vertically from said arcuate rim surface and which have substantially vertically extending penetrating knife edge portions, whereby contraction of opposing ones of said knife structures around a portion of said container neck which is positioned adjacent to the underside of said finish ring or lip will engage said neck engaging spikes with said container neck and said ring engaging spikes with said finish ring.

2. The knife structure of claim 1 wherein from 3-8 of each of said neck engaging spikes and from 3-8 of each of said ring engaging spikes are provided on said arcuate rim surface.

* * * * *